US006244262B1

(12) United States Patent
Keck

(10) Patent No.: US 6,244,262 B1
(45) Date of Patent: Jun. 12, 2001

(54) METHOD FOR CUTTING CONCRETE INTO PREDETERMINED SHAPES

(76) Inventor: Robert A. Keck, 4204 W. 162nd St., Lawndale, CA (US) 90260

( * ) Notice: Subject to any disclaimer, the term of this patent is extended or adjusted under 35 U.S.C. 154(b) by 0 days.

(21) Appl. No.: 09/473,289

(22) Filed: Dec. 28, 1999

(51) Int. Cl.[7] ..... B28D 5/00
(52) U.S. Cl. ..... 125/30.01; 451/28
(58) Field of Search ..... 264/133; 427/429, 427/154; 428/342.2, 355 EN, 81, 156, 49, 50; 125/30.01, 23.01, 24, 28, 38, 15; 404/34, 41, 42, 39; 451/28, 29

(56) References Cited

U.S. PATENT DOCUMENTS

| | | | | |
|---|---|---|---|---|
| 3,904,791 | * | 9/1975 | Iverson et al. | 427/277 |
| 4,681,481 | * | 7/1987 | Kapusta | 404/34 |
| 4,925,338 | * | 5/1990 | Kapusta | 404/41 |
| 5,478,390 | * | 12/1995 | Cruaud et al. | 106/713 |
| 5,537,987 | * | 7/1996 | Okawauchi | 125/15 |

* cited by examiner

*Primary Examiner*—Derris H. Banks
(74) *Attorney, Agent, or Firm*—Irving Keschner

(57) ABSTRACT

A method of forming a decorative shape from a concrete block by cutting the block into a predetermined shaped piece, polishing all flat surfaces and then applying a coating of clear material to the surface of said piece.

6 Claims, 1 Drawing Sheet

FIG. 1A
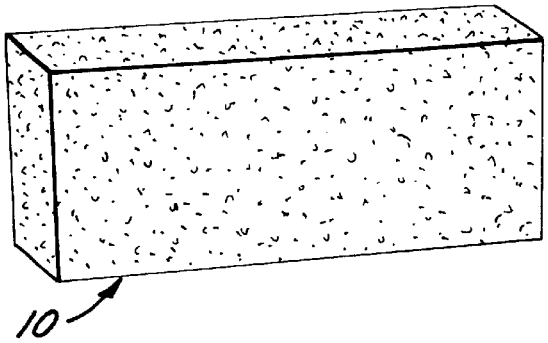
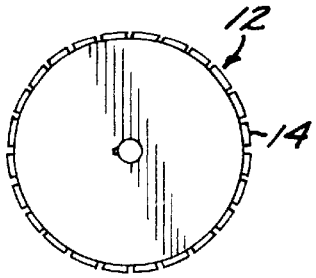
FIG. 1B
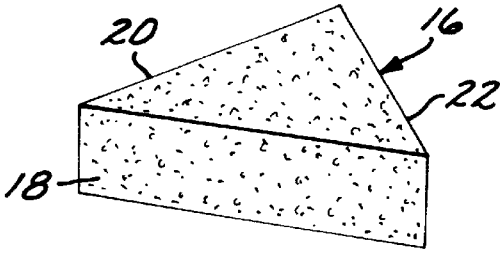
FIG. 2A
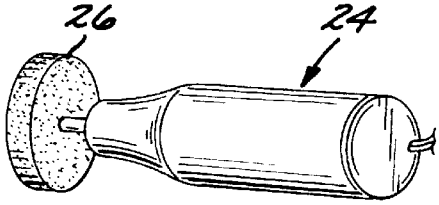
FIG. 2B
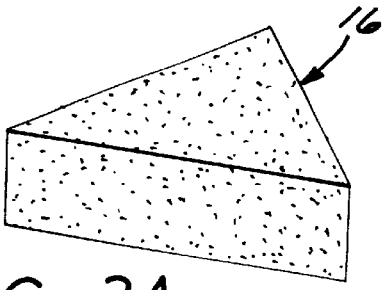
FIG. 3A
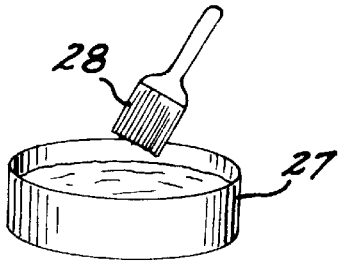
FIG. 3B
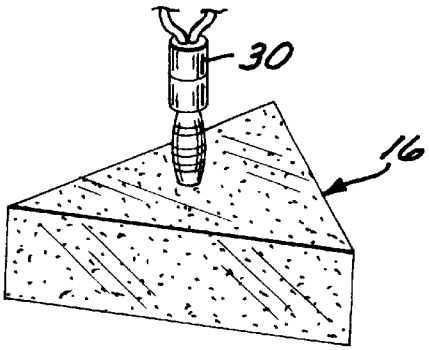
FIG. 4

METHOD FOR CUTTING CONCRETE INTO PREDETERMINED SHAPES

BACKGROUND OF THE INVENTION

1. Field of Invention

The present invention provides a method for cutting concrete in a manner whereby unique three-dimensional shapes are formed.

2. Description of the Prior Art

Apparatus for cutting concrete have been available in the prior art. For example, U.S. Pat. No. 5,579,753 to Chiuminatta et al discloses a saw for cutting grooves in the surface of wet concrete. The speed of a variable speed transmission device connected to the wheels used to propel the saw across the concrete during cutting is controlled, the speed being dependent upon whether the saw is cutting hard aggregate or soft concrete.

U.S. Pat. No. 5,223,200 to Schulz et al discloses a method for making concrete roof tiles. Specifically, a continuous layer of fresh concrete is deposited on pallets supplied in a continuous row and is subsequently compacted, the compacted layer of fresh concrete being cut into roof tile moldings of equal length with a front and a rear edge, the front edge also being trimmed.

Although the prior art exemplified above discloses various concrete cutting apparatus and techniques for forming particularly shaped concrete blocks, the prior art shaped blocks are utilized in construction related projects.

Processes for forming designs from various materials are also well known. For example, porcelain and glass bases for lamps have long been available. However, techniques for cutting formed concrete into designs that have consumer appeal are not currently available. What is thus desired is to provide a process for producing designs from formed concrete, the designs either having utilitarian features or created solely for its aesthetic appearance.

SUMMARY OF THE PRESENT INVENTION

The present invention provides a method of cutting formed concrete into shapes which can be used for specific functions, such as lamp bases, or solely for its aesthetic appearances.

The concrete is cut into the desired shaped piece using a diamond cutting tool. Flat surfaces that result from the cutting are polished using an abrasive disc wheel. An adhesive, clear coating is then applied to the cut aggregate and allowed to dry. Large pieces may have a core portion removed in order to reduce weight. The resulting piece is highly aesthetic and has many uses, such as lamp bases, paper weights and sculpture.

The process is simple and relatively inexpensive and provides a new form of decorative art having many uses.

DESCRIPTION OF THE DRAWINGS

For a better understanding of the invention as well as other objects and further features thereof, reference is made to the following description which is to read in conjunction with the accompanying drawing wherein:

FIG. 1A illustrates a block of concrete aggregate; and

FIG. 1B is a simplified plan view of a diamond concrete cutting tool;

FIG. 2A illustrates the concrete block of FIG. 1 cut to a desired shape; and FIG. 2B is a simplified view of a abrasive grinding tool;

FIG. 3A illustrates the concrete block after the flat edges are ground; and

FIG. 3B is a view illustrating the application of a clear adhesive to the surfaces of the piece illustrated in FIG. 3A; and FIG. 4 illustrates the piece of FIG. 3A, after application of the clear adhesive, formed as a lamp base.

DESCRIPTION OF THE INVENTION

Referring now to FIG. 1A, a concrete block 10 is illustrated. Formed concrete having aggregate therein is commonly available in block form, typically from sites whereat old buildings are being, or have been, demolished. As shown in FIG. 1B, a cutting tool 12 having a cutting surface 14 comprising diamonds is positioned to cut block 10 into a predetermined shape. A cutting tool which has been successfully utilized is the Meco 4 Speed Drill, manufactured by Meco Engineering Company, Prescott, Ariz. A cutting surface which has been utilized successfully is the Model PL10C 18×25 diamond cutting bit manufactured by Pro Link Diamond, Irvine, Calif. FIG. 2A illustrates one of numerous shapes that can be cut in accordance with the teachings of the invention. The particular shape illustrated is a wedge shaped piece 16 having flat surfaces 18, 20 and 22.

In accordance with the teachings of the invention, a masonry type grinder device 24, preferably using an abrasive disc wheel 26, is used to polish flat surfaces 18, 20 and 22. FIG. 3A illustrates polished piece 16. The next step of the inventive method is to apply a coating of clear, shining material to the surfaces of piece 16. As illustrated in FIG. 3B, a coating material (illustrated as stored in receptacle 26) is applied to the surfaces of piece 16 by brush 28. A preferred material which has been successfully utilized is polyurethane. Polyurethane highlights the color of the aggregate and provides viewing depth. Three coats have been applied to provide the desired effect, the second coating being applied after the first coating dries, the third coating being applied after the second coating dries. The total drying time is approximately twenty-four hours (other coatings, such as lacquer, can be used although lacquer will require more than three coatings).

FIG. 4 illustrates one application of the present invention. In particular, a hole is formed in piece 16 and a lamp structure 30 is secured therein, piece 16 forming a unique lamp base.

Concrete material can be removed from the piece 16 to reduce the weight thereof. In this case, a Model D5246 bit (6 inches) manufactured by Cushion Cut, Torrance, Calif., has been used to remove core material from shaped concrete pieces for weight reduction purposes.

The present invention thus provides a simple and cost effective technique for forming unique and aesthetically pleasing designs from concrete.

While the invention has been described with reference to its preferred embodiment, it will be understood by those skilled in the art that various changes may be made and equivalents may be substituted for elements thereof without departing from the true spirit and scope of the invention. In addition, many modifications may be made to adapt a particular situation or material to the teachings of the invention without departing from its essential teachings.

What is claimed is:

1. A method for making predetermined shapes from concrete to form a decorative piece having aggregate therein comprising the steps of:

providing a block of said concrete aggregate;

cutting the concrete aggregate using a diamond tool into a predetermined shaped piece, said shaped piece having an outside surface; and applying a coating of clear material on said outside surface of said shaped piece.

2. The method of claim 1 wherein flat surfaces are formed by cutting the concrete into said predetermined shaped piece.

3. The method of claim 2 further including the step of polishing said flat surfaces prior to applying said layer of clear material.

4. The method of claim 1 wherein said coating comprises polyurethane.

5. The method of claim 1 including the step of drying said coating after said coating is applied to the surface of said predetermined shaped piece.

6. A method for making predetermined shapes from concrete comprising the steps of:

providing a block of concrete;

cutting the concrete into a predetermined shaped piece, said shaped piece having an outside surface;

applying a coating of clear material on the outside surface of said shaped piece; and drilling a hole through said shaped piece.

* * * * *